US006065211A

United States Patent [19]

Birkert

[11] Patent Number: 6,065,211

[45] Date of Patent: May 23, 2000

[54] METHOD FOR MANUFACTURING A PART IN THE SHAPE OF A HOLLOW PROFILE

[75] Inventor: Arndt Birkert, Bretzfeld, Germany

[73] Assignee: DaimlerChrysler AG, Germany

[21] Appl. No.: 09/116,440

[22] Filed: Jul. 16, 1998

[30] Foreign Application Priority Data

Jul. 16, 1997 [DE] Germany ..... 197 30 481

[51] Int. Cl.[7] ..... B23P 11/00

[52] U.S. Cl. ..... 29/897.2; 29/421.1; 29/523; 72/62

[58] Field of Search ..... 29/897.2, 421.1, 29/523; 72/61, 62

[56] References Cited

U.S. PATENT DOCUMENTS

| | | | |
|---|---|---|---|
| 1,882,352 | 10/1932 | Woodhead et al. | 29/897.2 |
| 3,769,691 | 11/1973 | Puzik | 29/523 |
| 4,052,872 | 10/1977 | Herr | 72/62 |
| 4,132,437 | 1/1979 | Green | 29/523 |
| 4,151,632 | 5/1979 | Green | 29/523 |
| 4,469,356 | 9/1984 | Duret et al. | 29/523 |
| 4,761,981 | 8/1988 | Kelly | 72/62 |
| 4,980,961 | 1/1991 | Caudill | 29/523 |
| 5,093,990 | 3/1992 | Klippel | 29/897.2 |
| 5,203,190 | 4/1993 | Kramer et al. | 72/62 |
| 5,713,611 | 2/1998 | Kurimoto et al. | 29/523 |

FOREIGN PATENT DOCUMENTS 195 06 160 A1 8/1996 Germany .

*Primary Examiner*—Irene Cuda
*Assistant Examiner*—Trinh T. Nguyen
*Attorney, Agent, or Firm*—Evenson, McKeown, Edwards & Lehanan, P.L.L.C.

[57] ABSTRACT

A method for manufacturing a part in the shape of a hollow profile is disclosed, with a hollow profile made of light metal being expanded by high internal pressure deformation. In order to be able to manufacture parts in the shape of hollow profiles based on light metals, even with high degrees of deformation, in simple fashion in a safe process, a sleeve made of a material with a greater ductility than the light metal, especially a steel material, is slid onto the hollow profile. The sleeve is located on the hollow profile in such fashion that a predetermined area of the hollow profile is covered that is to be deformed during subsequent expansion with a high degree of deformation that exceeds the expandability of the light metal. The hollow profile is expanded by expansion by high internal pressure within this predetermined area to a degree beyond the bursting limit, whereupon the sleeve alone is expanded, subjected directly to high internal pressure at the burst point in the final shaped hollow profile, until the final shape of the part is reached in the area that is covered by the sleeve that is held at both ends in a press fit against the hollow profile.

19 Claims, 2 Drawing Sheets

METHOD FOR MANUFACTURING A PART IN THE SHAPE OF A HOLLOW PROFILE

BACKGROUND AND SUMMARY OF THE INVENTION

This application claims the priority of German application 197 30 481.8, filed in Germany on Jul. 16, 1997, the disclosure of which is expressly incorporated by reference herein.

The invention relates to a method for manufacturing a part in the shape of a hollow profile made of light metal or other materials of low elongation at rupture being expanded by internal high pressure shaping.

A method of this general type is known from DE 195 06 160 A1. In this method, parts in the shape of a hollow profile for a vehicle body made of aluminum, especially gusset elements in the frame structure, are manufactured by internal high-pressure shaping. However, manufacture of other light metal parts in which much higher degrees of shaping occur than the degree of shaping required to produce the final contours of gusset elements is not possible with conventional internal high-pressure shaping methods since because of the much lower elongation at rupture of light metals by comparison to that of steel materials for example, the bursting limit of hollow profiles is reached very quickly so that the material fails before the hollow profile comes in contact with the tool contour for producing the desired final shape. As a result, there is a high probability that rejects will be produced.

A goal of the invention is to improve on a method of the above noted type in such fashion that parts in the form of hollow profiles based on light metal or based on other materials with low elongation at rupture can be manufactured safely in simple fashion, even with high degrees of deformation.

This goal is achieved according to preferred embodiments of the invention by a method for manufacturing a part in the shape of a hollow profile, with a hollow profile made of light metal or other material of the hollow profile, or of other materials with low elongation at rupture being expanded by internal-high-pressure shaping, wherein a sleeve made of a material with a higher ductility than light metal, especially a steel material, is slid onto the hollow profile and is located on the hollow profile such that a predetermined area of the hollow profile is covered by the sleeve, with said predetermined area to be shaped during later expansion with a high degree of deformation that exceeds the expandability of the light metal, and wherein the hollow profile is expanded within this predetermined area by means of high internal pressure to a point beyond the burst limit, whereupon the sleeve is expanded alone, directly exposed to the high internal pressure above the burst point in the final-shaped hollow profile, until the final shape of the part is reached in the predetermined area that is held by the sleeve at both ends in a press fit on hollow profile.

By simply sliding a sleeve, available as a mass-produced product and made of a material that is more ductile than light metal, onto the light metal hollow shape, the area of the hollow profile covered by the sleeve can be expanded beyond its burst limit, in other words until the hollow profile bursts. Following the bursting of the hollow profile, further expansion of the sleeve takes its place in this area, and there, following completion of the expansion process, assumes the shape of the desired contour of the part. Because its material is more ductile, the sleeve can expand many times more under the influence of high internal pressure than can the hollow profile, without failing as a result of crack formation. Thus a part based on light metal can be manufactured safely with this process that requires very high deformation because of its deformation characteristics. Neither the hollow profile nor the sleeve need to fulfill particular quality requirements so that manufacturing is inexpensive. In addition, there is no significant additional expense for equipment for use in manufacturing. Leaks at the ends of the sleeve also cannot occur in the method according to the invention since, because they abut the tool engraving outside the burst area, they are held in a press fit against the hollow shape by the expansion pressure.

Other objects, advantages and novel features of the present invention will become apparent from the following detailed description of the invention when considered in conjunction with the accompanying drawings.

DETAILED DESCRIPTION OF THE DRAWINGS

Figure 1:
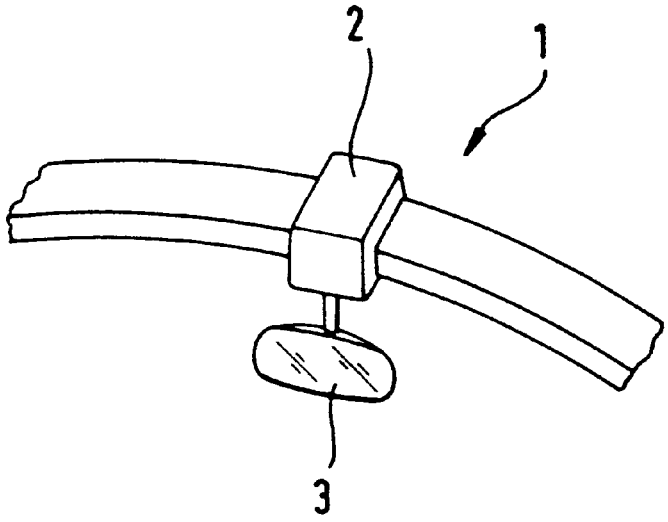
FIG. 1 is a partial perspective view of a front roof frame of a motor vehicle produced by the method according to the invention.
Figure 2:
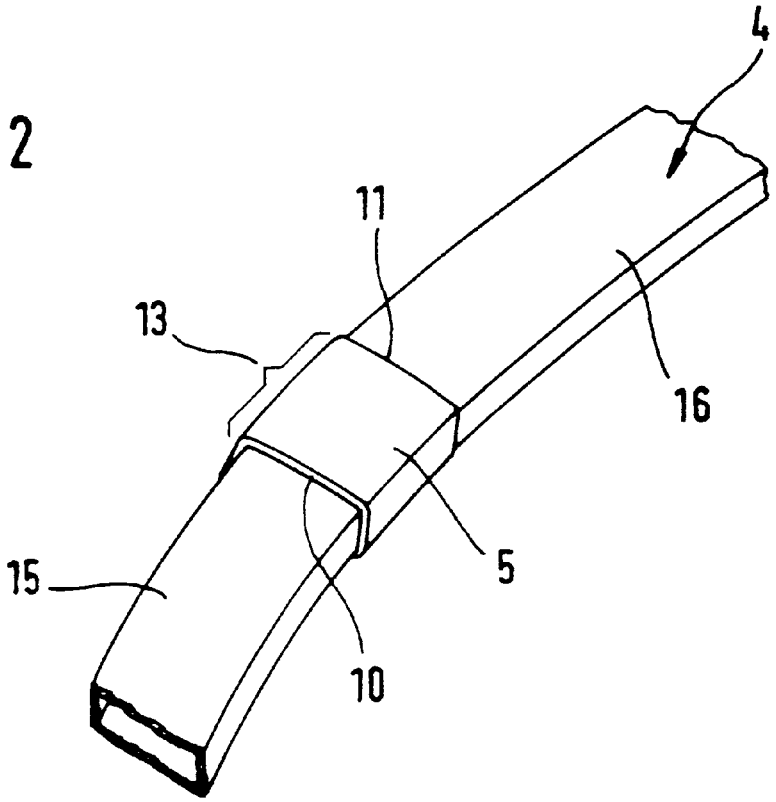
FIG. 2 is a perspective schematic view of a sleeve slid onto an elongate hollow profile in accordance with preferred embodiments of the invention.

FIG. 1 shows a part 1 in the shape of a hollow profile in the form of a front roof frame of a motor vehicle which has a bracket 2 located approximately centrally on which an inside mirror 3 is mounted. Part 1 consists, as its initial shape in FIG. 2 shows, of a hollow profile 4 made of a light metal, preferably of an extruded aluminum profile or of another material with low elongation at rupture such as high-strength steel for example, especially ZStE steel, and a sleeve 5 made of a steel material, preferably St 14 or stainless steel that determines the shape of the ultimate bracket 2 and is pushed onto hollow profile 4 into the predetermined position of bracket 2. In this position, sleeve 5 fits closely to hollow profile 4.

Figure 3:
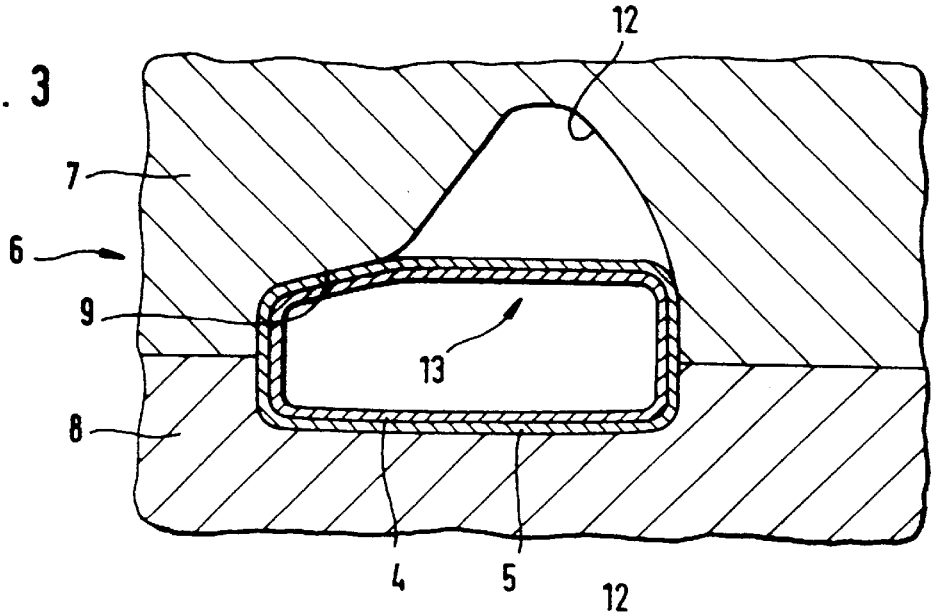
FIG. 3 is a cross section of a part manufactured according to a preferred embodiment of the invention, with a hollow profile and a sleeve slid onto the latter before the expansion process inside a tool used for internal high-pressure shaping.

After sleeve 5 is pushed onto hollow profile 4, the resultant composite profile is placed in a divided internal high-pressure tool 6 that incorporates an upper tool 7 and a lower tool 8 (FIG. 3). The engraving 9 of the shaping tool (6), corresponding to the contour and dimensions of the composite profile, is made essentially rectangular, but (in this case in upper tool 7 of shaping tool 6) in the area where sleeve 5 is located has a bulging recess 12 between its ends 10 and 11, said recess being made with a negative shape relative to the contour of the eventual bracket 2.

Figure 4:
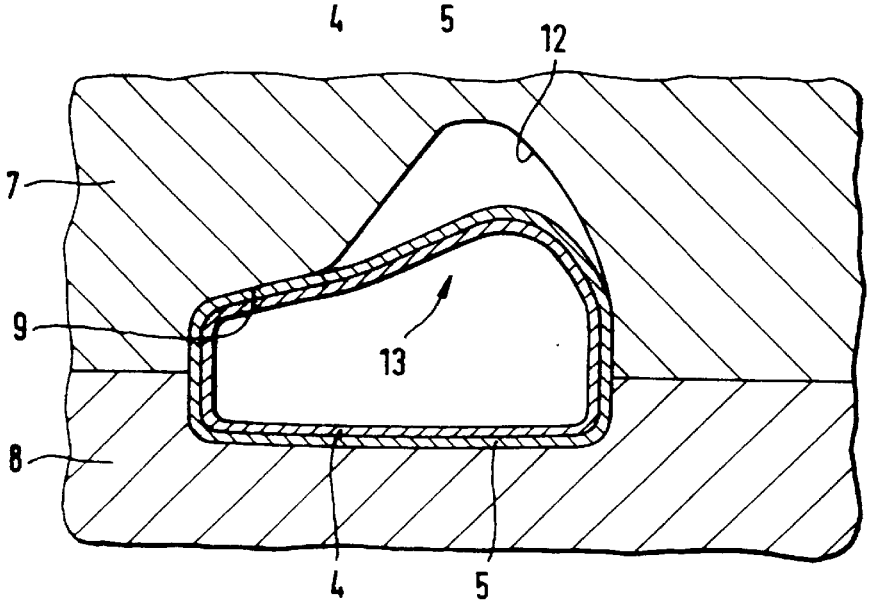
FIG. 4 is a cross section of the part in FIG. 3 showing the hollow profile and the sleeve expanded jointly in the final shape of the hollow profile.

After shaping tool 6 is closed, a pressure fluid is conducted into aluminum hollow profile 4 and subjected to high pressure. Hollow profile 4 and sleeve 5 are then expanded jointly by the high internal pressure, with the expansion area being limited solely to area 13 between the two ends 10, 11 of sleeve 5. These each lie in an annular groove machined into engraving 9 and open axially to face recess 12. In this position, the insides of sleeve ends 10, 11 are flush with the remaining contour of engraving 9 outside area 13. By abutting ends 10, 11 against engraving 9 of shaping tool 6 and by applying the expansion pressure, sleeve 5 is clamped in sealing fashion and, because of the expansion pressure that presses hollow profile 4 against sleeve 5, assumes a very tight press fit. Then area 13, as shown in FIG. 4, bulges out to fit the contour of recess 12. It is always important to check in advance that sleeve 5 has dimensions such that it will completely cover expansion area 13 in which high degrees of deformation occur.

Figure 5:
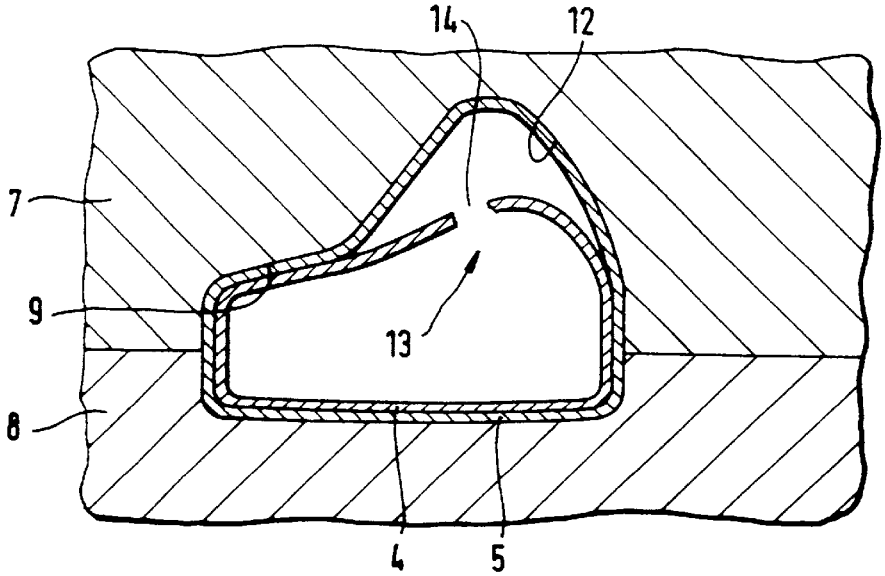
FIG. 5 is a cross section of the finished part in FIG. 3 with a burst hollow profile.

Since very high degrees of deformation are required up to the theoretically direct (because of being surrounded by sleeve 5) contact of hollow profile 4 against the contour of recess 12, the limit of elongation to rupture or the bursting limit of hollow profile 4 is reached and exceeded long before contact with the contour of the recess because of the low ductility of aluminum in the bulged shape of hollow profile 4 shown in FIG. 4. Then hollow profile 4 bursts in expansion area 13, whereupon sleeve 5 is exposed directly to the pressure fluid through the resultant crack 14 (FIG. 5). Pressure equalization then takes place in expansion area 13 relative to hollow profile 4, so that no further expansion of hollow profile 4 takes place at this location. Sleeve 5, which alone is subjected to high internal pressure, expands without tearing because of its greater ability to expand and/or because of the ductility of its steel material, and abuts the contour of recess 12 of engraving 9 to fit the contours. At this moment, the final shape of part 1 is reached. The pressure fluid is then depressurized and part 1 is removed after opening shaping tool 6.

It is also contemplated within the scope of the invention for profile sections 15, 16 located outside area 13 to be shaped with a high degree of deformation to be given their final shape by means of high internal pressure.

In order to achieve a high-quality form for these profile sections 15, 16, after hollow profile 4 is placed in a correspondingly adapted engraving 9 of shaping tool 6, its profile sections 15 and 16 are expanded and calibrated initially by a first expansion of hollow profile 4 by means of high internal pressure. Only then is sleeve 5 slid over profile sections 15, 16 in their final shapes onto the point in area 13 of hollow profile 4 to be reshaped with a high degree of deformation, whereupon hollow profile 4 is expanded at this point within this area 13 beyond the bursting limit by further expansion by means of high internal pressure. It is possible in this connection to use a high-internal-pressure shaping tool 6 for the initial expansion that is separate as far as additional expansion is concerned. In this case, when shaping a high degree of deformation, unfavorable stress conditions in area 13 are avoided which otherwise occur because of the cold hardening that takes place prior to additional expansion in sleeve 5 and in the area 13 that is covered. In addition, in a manner that is advantageous as far as the tools involved are concerned, a very simple engraving pattern is obtained, both in the shaping tool for the first expansion and also in the shaping tool for the second expansion.

When the same tool is used for both expansions, which is also contemplated according to certain preferred embodiments, recess 12 of engraving 9 designed for shaping with a high degree of deformation must be covered by an insert or a slide for the first expansion, so that although a shaping tool is eliminated by comparison with the previous design, there is an additional equipment cost for the slide or insert. Recess 12 must be covered because profile sections 15, 16 can only be given a high-quality final shape if no failure of hollow profile 4 has already occurred in area 13. In addition, sleeve 5 otherwise could not be pushed subsequently onto hollow profile 4 since hollow profile 4 bulges outward into recess 12 precisely in area 13 when subjected to high internal pressure, over which area sleeve 5 must be positioned.

Alternatively it is possible to slide sleeve 5, prior to the first expansion process, onto hollow profile 4 in area 13 to be covered by sleeve 5. Profile sections 15, 16 are given the final shape of part 1 as the result of expansion by means of high internal pressure in a single shaping tool 6 with a suitably designed engraving 9, with loosely fitting sleeve 5 obtaining a press fit against hollow profile 4. Because sleeve 5 has already been pushed on before expansion, no pusher located in area 13 is required, simplifying shaping tool 6, since when hollow profile 4 tears when expanded beyond the burst limit, there is no pressure drop caused by sealing sleeve 5 and so profile sections 15, 16 can be sized to the final shape of part 1. In this form of the method, there is no need for intermediate opening of shaping tool 6 and removal of hollow profile 4 to slide on sleeve 5 following initial expansion, so that processing time is gained. Sleeve 5 should also be designed so that its two ends 10, 11 have the narrowest cross section along the entire length of the sleeve so that the tightness of sleeve 5 is produced by a press fit during subsequent expansion. Between its two ends 10, 11 sleeve 5 can have any possible initial shape within the framework of the expansion volume that bulges outward and of the geometry of the final shape of part 1 in area 13.

It is also advantageous for sleeve 5 to abut hollow profile 4 over its entire length in a sliding or press fit since as a result, sleeve 5 and hollow profile 4 are expanded jointly during subsequent expansion, and sleeve 5, following its shaping as a result of the expansion of hollow profile 4, is subjected practically to a smooth transition upon bursting of hollow profile 4 in a way that protects the process and is not abruptly subjected directly to the high internal pressure so that it bursts itself. The entire shaping of the sleeve thus takes place in a single continuous shaping movement even with crack formation in hollow profile 4.

It is also advantageous for hollow profile 4 that is to be shaped with a high degree of deformation, to be torn in locally concentrated fashion and deliberately by means of high internal pressure in an expansion process that exceeds the burst limit, by means of high internal pressure in area 13 of hollow profile 4 so that crack formation is targeted at the predetermined location, where the mechanical stress on finished part 1 is not very high and where the notch effect of crack 14 produced in hollow profile 4 is either absent or is present to only a limited degree and does not damage the stability of part 1. Deliberate tearing is achieved by indenting hollow profile 4 at the desired location in area 13, and this point has a comparatively small wall thickness relative to the surrounding area. This specified breaking point can be in the shape of a point or a line.

Finally, in creating a specified breaking location, it is very advantageous to make the latter in the shape of a closed curve. As a result, from hollow profile 4, in the expansion process that goes beyond the bursting limit, a slug is practically torn out by means of high internal pressure so that because of the lack of a crack direction due to the closed tearing curve, any notching effect that takes place under mechanical stressing of part 1 is suppressed in advance.

Part 1 manufactured according to the invention can also be made not only as a roof frame but can also represent a chassis member or axle. Other uses are contemplated in vehicle production as well as in other technical areas not related to vehicles.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method of manufacturing a hollow profile part by internal-high-pressure shaping comprising:

providing a hollow profile made of a material having a low elongation at rupture;

sliding a sleeve over a predetermined length section of the hollow profile, said sleeve being made of a higher ductility material than said hollow profile; and applying high pressure fluid into said hollow profile sufficient to burst said hollow profile which is surrounded by the sleeve; and subsequently expanding said sleeve alone to thereby form a composite part including the hollow profile and sleeve clamped together.

2. Method according to claim 1, wherein said hollow profile is formed by internal-high-pressure fluid deformation prior to sliding said sleeve over the hollow profile.

3. Method according to claim 1, wherein said sleeve is slid over the hollow profile, followed by deformation of the hollow profile and the sleeve by the application of internal-high-pressure fluid into the hollow profile.

4. Method according to claim 1, wherein said part is a vehicle frame part.

5. Method according to claim 4, wherein said vehicle frame part is a front roof frame of a motor vehicle which has a bracket on which an inside mirror is mounted.

6. Method according to claim 1, wherein said vehicle frame part is a chassis member.

7. A method for manufacturing a part in the shape of a hollow profile, comprising:

providing a hollow profile;

sliding a sleeve having two ends onto a predetermined area of a hollow profile, said hollow profile comprises a material having a low elongation at rupture, wherein said sleeve has a higher ductility than the material;

expanding the hollow profile and said sleeve in the predetermined area by high internal pressure;

press fitting the two ends of the sleeve onto said hollow profile;

expanding the hollow profile in the predetermined area to a point beyond its bursting limit; and continuing to expand the sleeve alone, wherein said sleeve is directly exposed to said high internal pressure in the predetermined area into a final shape of the part is reached.

8. A method according to claim 7, wherein the hollow profile material comprises a light metal.

9. A method according to claim 7, wherein the sleeve comprises a metal.

10. A method according to claim 9, wherein the metal is steel.

11. A method according to claim 7, further comprising expanding sections of the hollow profile outside the predetermined area by high internal pressure to a final shape prior to said expanding the hollow profile and the sleeve in the predetermined area.

12. A method according to claim 11, wherein said expanding sections of the hollow profile outside the predetermined area is prior to said sliding the sleeve onto the predetermined area of the hollow profile.

13. A method according to claim 11, wherein the two ends of the sleeve are press fit onto the hollow profile during said expanding sections of the hollow profile outside the predetermined area.

14. A method according to claim 7, further comprising forming a breaking location on the hollow profile at which the hollow profile bursts in a locally concentrated manner.

15. A method according to claim 14, wherein said forming is by indenting the hollow profile so that the breaking location has a smaller wall thickness than the surrounding hollow profile.

16. A method according to claim 14, wherein the breaking location is a closed curve.

17. A method according to claim 11, wherein the part is a vehicle frame part.

18. A method according to claim 17, wherein the vehicle frame part is a front roof frame of a motor vehicle having a bracket on which an inside mirror is mounted.

19. A method according to claim 17, wherein the vehicle frame part is a chassis member.

* * * * *